United States Patent [19]

Folkerts

[11] 4,397,273

[45] Aug. 9, 1983

[54] RETRACTABLE ENGINE IGNITER

[75] Inventor: Charles H. Folkerts, Royal Oak, Mich.

[73] Assignee: General Motors Corporation, Detroit, Mich.

[21] Appl. No.: 255,802

[22] Filed: Apr. 20, 1981

[51] Int. Cl.[3] ..... F02P 19/02

[52] U.S. Cl. ..... 123/145 A; 123/179 BG

[58] Field of Search ..... 123/145 A, 145 R, 179 H, 123/179 BG

[56] References Cited

U.S. PATENT DOCUMENTS

| | | | |
|---|---|---|---|
| 1,280,748 | 10/1918 | Jernberg | 123/145 A |
| 1,441,711 | 1/1923 | Petter | 123/145 A |
| 4,240,392 | 12/1980 | Matayoshi et al. | 123/145 A |

FOREIGN PATENT DOCUMENTS

| | | | |
|---|---|---|---|
| 52-44346 | 4/1977 | Japan | 123/145 A |

*Primary Examiner*—Charles J. Myhre
*Assistant Examiner*—Andrew M. Dolinar
*Attorney, Agent, or Firm*—Robert J. Outland

[57] ABSTRACT

An igniter, such as a glow plug for diesel engines, is arranged to be extended into a combustion chamber of an associated engine when needed to aid starting and ignition. It is retracted from the combustion chamber when starting aid is no longer required in order to reduce interference with gas flow in the combustion chamber and the formation of particulates in the combustion process. Various powered arrangements are disclosed for retracting and extending the glow plug during engine operation using energy sources such as combustion chamber pressure and engine temperature which are obtained separately from an engine accessory power system.

7 Claims, 9 Drawing Figures

RETRACTABLE ENGINE IGNITER

TECHNICAL FIELD

This invention relates to retractable igniters, or glow plugs, for use in compression ignition internal combustion engines such as diesel engines. In particular, the invention relates to multi-position glow plugs adapted for insertion into and retraction from an associated combustion chamber and to powered means using available energy for positioning such glow plugs.

BACKGROUND

It is known in the art relating to compression ignition or diesel engines, especially of the prechamber type, to provide an igniter or glow plug mounted in the wall of and extending into the combustion chamber to provide a heat source to aid ignition of the charge during starting. Generally such glow plugs are electrically heated and are required to operate only during starting and warm-up of the engine. Thereafter, temperatures in the combustion chamber reach a point where reliable compression ignition is obtained without the need for added heat.

However, test results have indicated that the presence of a glow plug unit in the combustion chamber or prechamber of the diesel engine during normal running may have an adverse effect upon exhaust emissions and operating efficiency. In particular, it appears the glow plug may represent an obstruction to gas flow which may increase the production of particulates during combustion. The obstructing effect of the glow plug may be reduced by streamlining or retracting the plug unit to reduce or eliminate its interference with swirl or other normal gas flow patterns within a prechamber.

It has been proposed to retract a glow plug igniter into the combustion chamber wall when not in operation to remove it from interfering with swirl and air flow in the combustion or precombustion chamber during engine operation after the warm-up period. Glow plug retraction arrangements are shown, for example, in U.S. Pat. Nos. 1,280,748 Jernberg, 1,441,711 Petter and 4,240,392 Matayoshi et al. The latter disclosure shows straightforward direct acting electrical solenoid and hydraulic actuating devices for inserting and maintaining glow plug units in a combustion chamber during operation. However, such arrangements may not be the most effective and may require more power to operate than is desirable.

SUMMARY OF THE INVENTION

The present invention proposes a number of forms of power-positioned glow plug or igniter units which are actuated at least in part by available energy sources that do not add much or at all to the required power capability of the accessory power systems of the engine. Such available energy sources include, for example, variable engine cylinder pressures and engine temperatures which vary between operating and non-operating modes.

Further features and advantages of the invention will be more fully understood from the following description of a number of alternative embodiments taken together with the accompanying drawings.

IN THE DRAWINGS

DETAILED DESCRIPTION

Figure 1:
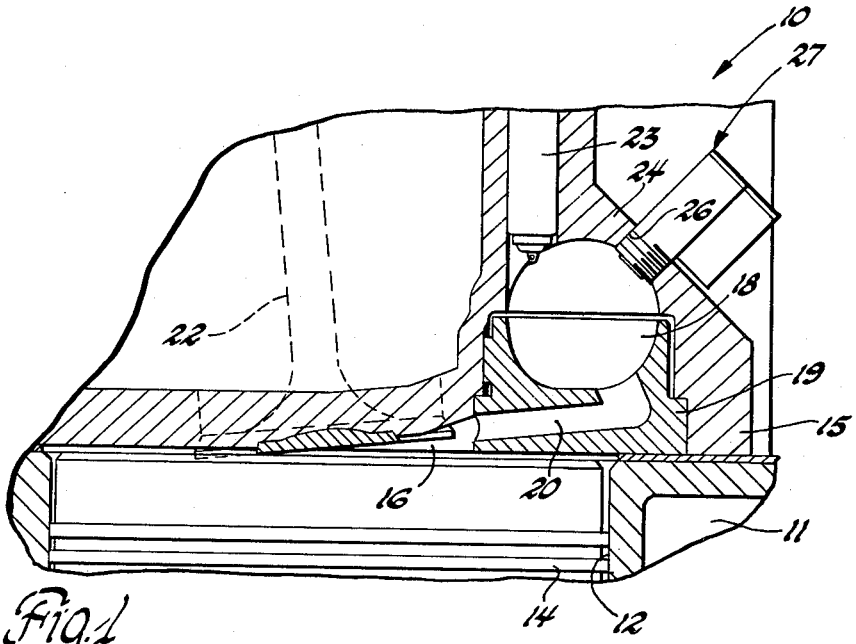
FIG. 1 is a fragmentary cross-sectional view through the combustion chamber portion of an automotive diesel engine having a power-positioned glow plug igniter formed in accordance with the present invention.

Referring first to FIG. 1 of the drawings, numeral 10 generally indicates an internal combustion engine of the diesel type. Engine 10 includes a cylinder block 11 defining a cylinder 12 in which a piston 14 is reciprocable in conventional fashion. A cylinder head 15 is mounted on top of the cylinder block, closing the end of the cylinder 12 to define a main combustion chamber 16 opposite the end of the piston 14. Within the cylinder head is a precombustion chamber or prechamber 18 defined in part by a prechamber insert 19 in which there is formed a restricted passage 20 that communicates the main chamber 16 with the prechamber 18.

Conventional means, including an exhaust valve 22, are provided for admitting and exhausting air and exhaust products from the main combustion chamber. Fuel is supplied by a fuel system having a fuel injection nozzle 23 discharging into the prechamber. The prechamber wall 24 is also provided with a threaded opening 26 in which there is received a power-positioned adjustable glow plug unit in accordance with the present invention and generally indicated by numeral 27.

Figure 2:
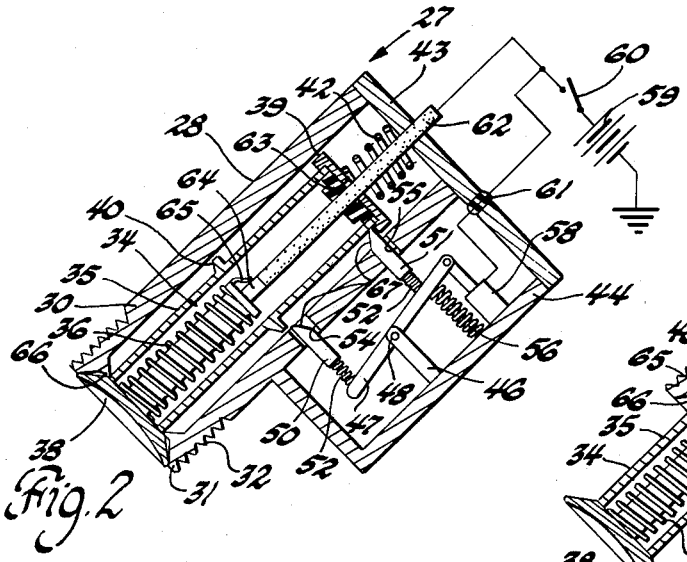
FIG. 2 is a cross-sectional view showing the internal construction of the igniter used in the engine of FIG. 1 disposed in its retracted position.
Figure 3:
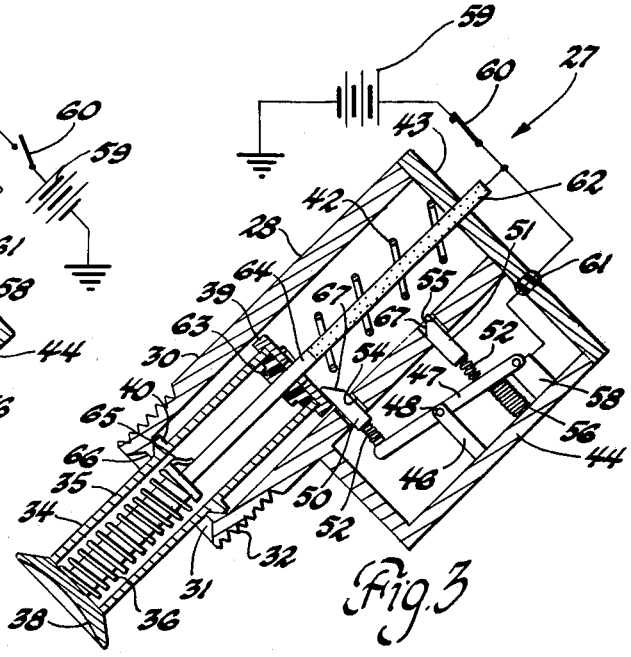
FIG. 3 is a cross-sectional view of the igniter of FIG. 2 disposed in its extended position.

FIGS. 2 and 3 of the drawings illustrate in detail the construction of the glow plug unit 27 used in the engine of FIG. 1. The unit 27 includes a housing 28 having a cylindrical body portion 30 that is open at one end 31 which is externally threaded at 32 for engagement with the threaded opening 26 of the engine cylinder head combustion chamber wall.

Within the cylindrical body 30 there is reciprocably carried a glow plug 34 that includes a tubular shield 35 enclosing a spirally wound heating element 36. The shield 35 is closed at its ends by outer and inner end caps 38, 39 respectively, and a ring 40 extends around the shield intermediate its ends. A spring 42, acting between a closed end 43 of the housing 28 and the inner end cap 39, urges the glow plug toward its extended position as shown in FIG. 3.

Glow plug housing 28 further includes an enclosure portion 44 extending from one side of the body portion 30 and containing a mechanism including a support post 46 pivotally mounting a lever 47 that supports on opposite sides of its pivot 48 a pair of control pins 50, 51. These pins 50, 51 are connected to the lever 47 by springs 52 and extend through openings 54, 55 of the body portion 30 to permit their engagement with the end cap 39 and ring 40 as will be subsequently more fully discussed.

A control spring 56 urges the lever 47 in a counterclockwise direction as shown in the drawings and a solenoid 58 connected with the lever is adapted when energized to overcome the bias of spring 56 and move the lever 47 in a clockwise direction to the position shown in FIG. 3. Electrical current to operate the solenoid 58 and heating element 36 is supplied from a suitable source such as battery 59 through switch 60. Insulators 61, 62 protect the current conducting wires from grounding on the housing. A third insulator 63 inside the glow plug end cap 39 prevents grounding of a conductive extension 64 of the insulator 62 which is engaged by a sliding contact finger 65 on the glow plug to conduct electrical current to the electrical heating element 36.

It should be noted that the interior of the open end 31 of the cylindrical body 30 is provided with a seat ring 66 that is sealingly engaged by the glow plug outer end cap 38 and the ring 40 in the retracted and extended positions of the glow plug 34 respectively. Further, the control pins 50, 51 are provided with ramp surfaces 67 for purposes to be described.

In operation, before starting of the engine, the glow plug will normally reside in the retracted position shown in FIG. 2. It is held in this position by engagement of the control pin 51 with the end cap 39 maintained by the urging of the control spring 56 on lever 47. When it is desired to start the engine, the switch 60 is closed manually or by any suitable external control system not shown. This allows current to flow to the solenoid 58 which causes the lever 47 to rotate clockwise to the position shown in FIG. 3. This action retracts the control pin 51 into its opening 55 and extends control pin 50 through opening 54 into engagement with the glow plug shield 35.

The retraction of pin 51 frees the glow plug from restraint in the retracted position and allows spring 42 to force it outwardly to the extended position shown in FIG. 3. The ramp surface 67 on pin 50 allows the end cap 39 to slide past the pin after which pin 50 engages the end of the cap 39 and locks the glow plug in its extended position wherein the ring 40 is sealingly seated on the seat ring 66 of the body.

Closing of the switch 60 also provides current to the heating element 36 which warms the surrounding portion of the shield 35 that now extends into the inner portion of the prechamber 18. Thus, after a predetermined interval sufficient to raise the glow plug shield to a desired temperature, the engine may be started and the hot glow plug will aid ignition of the fuel-air mixtures formed within the prechamber.

Subsequently, when engine operation reaches a normal condition and ignition aid from the glow plug is no longer required, the switch 60 is opened and current is cut off to the solenoid 58 and heating element 36. This action allows spring 56 to again move lever 47 counterclockwise to the position shown in FIG. 2, withdrawing control pin 50 and extending control pin 51. When this is accomplished, the glow plug is retracted by the force developed by the intermittent high pressure reached within the prechamber which acts against the outer end cap 38 and forces the glow plug into the body portion 30, compressing the spring 42. When the inner end cap 39 slides past the ramp surface 67 of pin 51, the cap is engaged and locked in position by the back side of the pin. The glow plug is then retained in its retracted position as shown in FIG. 2.

The glow plug unit then remains in the retracted position during continued operation of the engine wherein the glow plug is completely withdrawn from the prechamber and thus avoids disturbing in any way the swirling flow of the burning air-fuel charge therein. It should be noted that the end cap 38 is preferably recessed on its outer surface to provide a smooth blending with the inside wall surface of the prechamber so as to present a minimum disturbance to flow when the glow plug is in the recessed position. Since actuation of the glow plug to its retracted and extended positions is accomplished directly by combustion chamber pressure and a spring, respectively, and electric power is used only for actuating the locking pins, it is seen that only limited accessory power is necessary to operate the described system.

ALTERNATIVE EMBODIMENTS

In FIGS. 4 through 9, there are described a number of alternative embodiments of glow plug units which could be used in various types of diesel engines, including the type shown in FIG. 1, in place of the embodiment previously described and illustrated in FIGS. 2 and 3. For simplicity, the description of components similar to those of the embodiment of FIGS. 2 and 3 will not be repeated and such components will be identified by reference numerals similar to those used in FIG. 2 but differing by multiples of 100.

It should be apparent that any number of low-energy operated alternative mechanisms might be devised for actuating a retractable glow plug device into retracted and extended positions. The embodiment of FIGS. 2 and 3 discloses a system wherein movement of the glow plug itself is accomplished by cylinder pressure and an opposing spring. Maintenance of the glow plug in the desired position is then accomplished by an electrically controlled locking mechanism. The various alternative embodiments illustrated in FIGS. 4 through 9 are but examples of some of the other limited energy mechanisms which may be utilized and fall into categories using hydraulic, or pneumatic control, thermal controlled devices and electrically controlled hydraulic devices.

Figure 4:
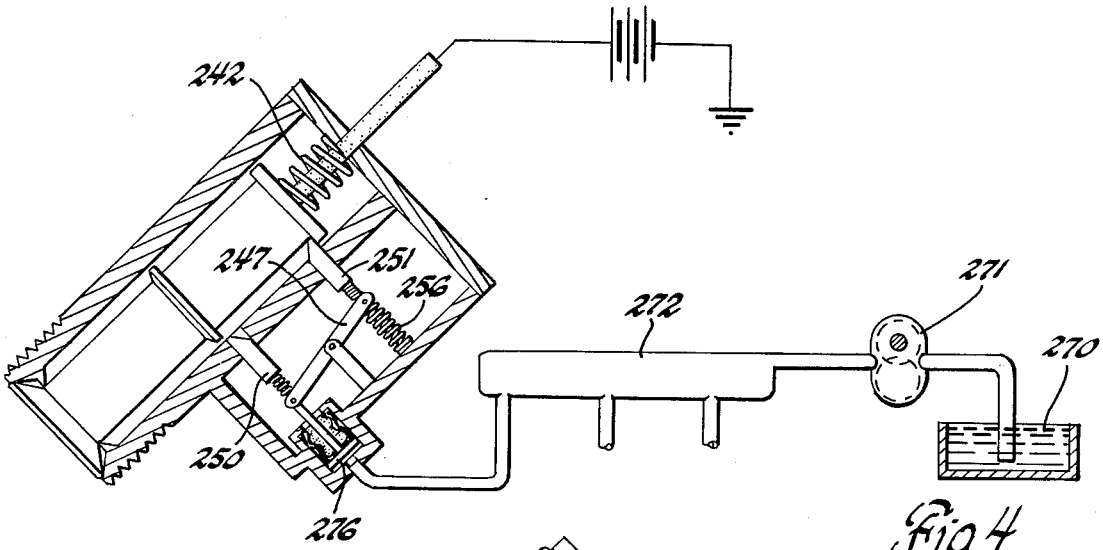
FIGS. 4 through 9 are cross-sectional views showing the internal construction of various alternative embodiments of power-positioned igniters formed in accordance with the invention.

The embodiment of FIG. 4 is an indirectly actuated arrangement similar to that of FIGS. 2 and 3, except that the locking mechanism is actuated hydraulically rather than electrically. Thus the rocking lever 247 is controlled by a hydraulic system including a reservoir 270, pump 271 and conduit 272 which actuate a hydraulic piston 276 opposing spring 256. Thus, the movement of lever 247 actuates control pins 250 and 251 to permit spring 242 to move the glow plug to its extended position when the heating element, not shown, is energized and to allow cylinder pressure to retract the glow plug and lock it in its retracted position shown in FIG. 5 when the glow plug heating element is de-energized.

Figure 5:
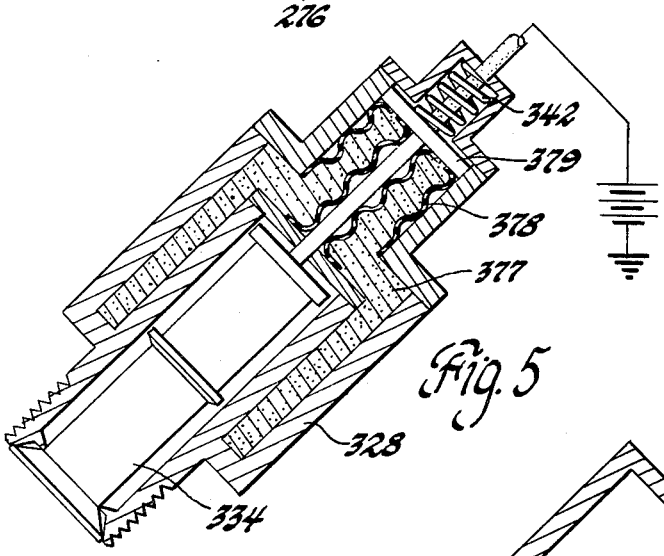

FIGS. 5 through 8 illustrate devices whereby control of the glow plug movement is obtained by thermal expansion of various materials and devices. In FIG. 5, the housing 328 contains a temperature responsive fluid material 377 such as liquid, jelly or paste which expands from engine heat and thereby acts through a bellows 378 on a piston 379 connected with the glow plug 334 to directly urge it to its retracted position. When the unit is cold, spring 342 forces the glow plug into its extended position within an associated engine combustion chamber, where it is in position to aid the ignition of air-fuel mixtures during starting and warm-up of the engine.

This embodiment has the advantage that no accessory power is required to physically move the glow plug to its retracted and extended positions. Also, the temperature responsive material can be arranged to extend the glow plug only when engine temperatures are low enough to require starting aid. If desired, energizing of the glow plug can be controlled by its movement into the cylinder and cut off by retraction from it, thereby obviating the need for additional control means.

Figure 6:
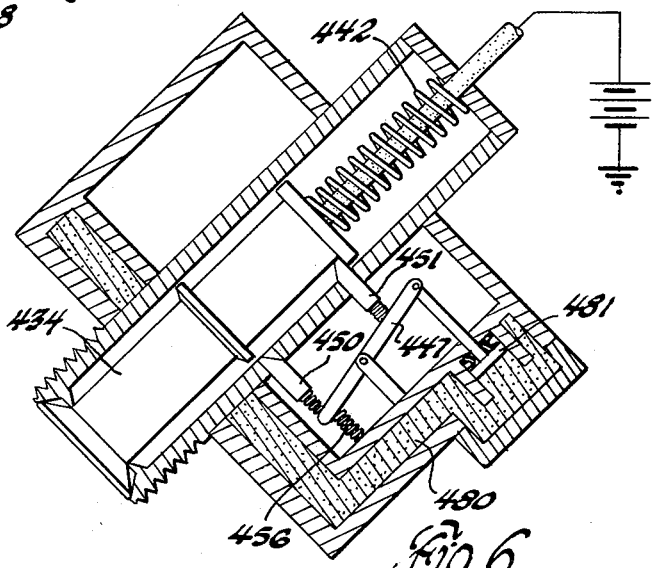

In the embodiment of FIG. 6, a similar expansible fluid 480 acts upon a piston 481 to control a lever 447 and locking pins 450 and 451. When the engine is cold, a spring 442 is permitted to move the glow plug 434 to its extended position where it is locked by pin 450 urged into position by control spring 456 acting on the lever 447. Heating of the fluid 480 by engine operation causes piston 481 to rotate lever 447 counter-clockwise, withdrawing pin 450 and engaging pin 451. This permits cylinder pressure to retract the glow plug and locks it in the retracted position.

Figure 7:
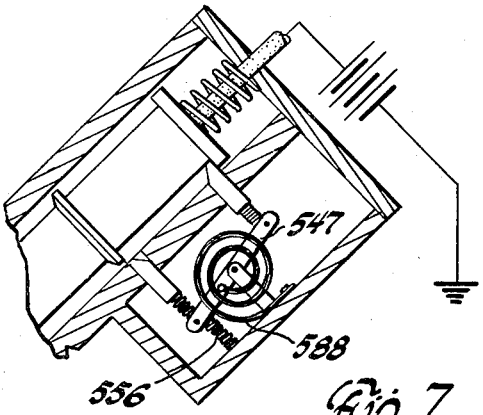

In FIG. 7, a mechanism similar to that of FIG. 6 is actuated by a bimetallic coil 582 which overcomes the bias of control spring 556 to urge lever 547 counter-clockwise when the coil 582 is heated by engine heat, thus permitting cylinder pressure to retract the glow plug and locking it in the retracted position.

Figure 8:
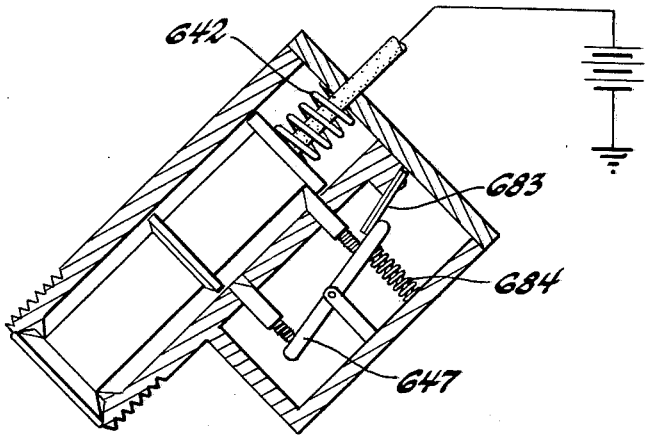

Similar action is accomplished in the embodiment of FIG. 8 by a bimetallic strip 683 which, when cold, urges lever 647 clockwise against the bias of control spring 684 to lock the glow plug in its extended position where it is moved by spring 642. Heating of the strip 683 by engine operation relaxes its force and allows spring 684 to rotate lever 647 counter-clockwise, moving the position of the locking pins to allow retraction of the glow plug by cylinder pressure and retention in the retracted position by the locking pins.

Figure 9:
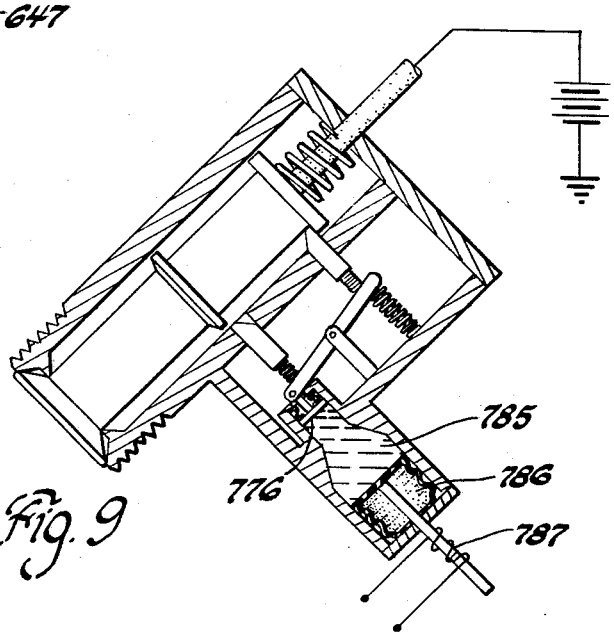

In the embodiment of FIG. 9, operation of the lever and piston mechanism is the same as in FIG. 4 but the hydraulic fluid 785 is actuated by a bellows 786 moved by a solenoid 787. The piston 776 has a substantially smaller area exposed to the hydraulic fluid than does the bellows 786, thereby allowing a small motion of the solenoid actuated bellows to provide a relatively larger motion of the hydraulically actuated piston 776.

While numerous alternative embodiments have been disclosed, it should be apparent that many variations and modifications could be made without departing from the inventive concepts described. Since these and other modifications may be made by those skilled in the art, it is intended that the invention not be limited to the disclosed embodiments but that it have the full scope permitted by the language of the following claims.

The embodiments of the invention in which an exclusive property or privilege is claimed are defined as follows.

1. A power-positioned igniter for use in a compression ignition internal combustion engine having a wall defining a combustion chamber, said igniter comprising, a housing having an open end adapted to form a portion of said combustion chamber wall, a glow plug carried in said housing and reciprocably movable between extended and retracted positions, said glow plug protruding through said open end into the combustion chamber when in the extended position and being operable therein to heat combustible mixtures in the chamber to aid their ignition, said glow plug being withdrawn through the wall of said chamber into said housing when in said retracted position to reduce gas flow disturbances in the chamber during periods of operation when supplemental aid to ignition is not required, and powered means selectively operative to position said glow plug in either of its extended or retracted positions upon the occurrence of predetermined events, said powered means including resilient means continuously biasing said glow plug toward its extended position and force applying means using energy from intermittent combustion chamber pressures acting in a retracting direction on the glow plug during engine operation and operative in response to a predetermined condition to move said glow plug into its retracted position against the bias of said resilient means.

2. A power-positioned igniter for use in a compression ignition internal combustion engine having a wall defining a combustion chamber, said igniter comprising, a housing having an open end adapted to form a portion of said combustion chamber wall, a glow plug carried in said housing and reciprocably movable between extended and retracted positions, said glow plug protruding through said open end into the combustion chamber when in the extended position and being operable therein to heat combustible mixtures in the chamber to aid their ignition, said glow plug being withdrawn through the wall of said chamber into said housing when in said retracted position to reduce gas flow disturbances in the chamber during periods of operation when supplemental aid to ignition is not required, and powered means selectively operative to position said glow plug in either of its extended or retracted positions upon the occurrence of predetermined events, said powered means including resilient means continuously biasing said glow plug toward its extended position with a force less than the force of intermittent combustion chamber pressure acting in a retracting direction on the glow plug during engine operation, and powered locking means operative in a first operating mode to permit said resilient means to move said glow plug into its extended position and to maintain said position against said combustion pressure force and further operative in a second operating mode to permit said combustion pressure force to move the glow plug to its retracted position and to maintain said position against the force of said resilient means.

3. An igniter according to claim 2 wherein said powered locking means is electrically actuated.

4. An igniter according to claim 2 wherein said powered locking means is fluid actuated.

5. An igniter according to claim 2 wherein said powered locking means is mechanically actuated.

6. An igniter according to claim 2 wherein said powered locking means is actuated by a temperature responsive device.

7. An igniter according to claim 2 wherein said powered locking means is actuated by a device responsive to an electrical signal.

* * * * *